US007775563B2

(12) United States Patent
Liang et al.

(10) Patent No.: US 7,775,563 B2
(45) Date of Patent: Aug. 17, 2010

(54) MORTISE LOCK FOR A SLIDING DOOR

(75) Inventors: Luke Liang, South Plainfield, NJ (US); Toni Liang, Guangzhou (CN); David Chen, Guangzhou (CN)

(73) Assignee: Vision Industries Group, South Plainfield, NJ (US)

( * ) Notice: Subject to any disclaimer, the term of this patent is extended or adjusted under 35 U.S.C. 154(b) by 393 days.

(21) Appl. No.: 11/447,667

(22) Filed: Jun. 6, 2006

(65) Prior Publication Data

US 2007/0290511 A1 Dec. 20, 2007

(51) Int. Cl.
*E05C 7/00* (2006.01)

(52) U.S. Cl. ..... 292/25; 292/49; 292/102; 292/51; 292/DIG. 46

(58) Field of Classification Search ..... 292/25–31
See application file for complete search history.

(56) References Cited

U.S. PATENT DOCUMENTS 7,040,671 B2 * 5/2006 Liu et al. ..... 292/24
7,422,249 B2 * 9/2008 Glover ..... 292/199

* cited by examiner

*Primary Examiner*—Pete M. Cuomo
*Assistant Examiner*—Mark Williams
(74) *Attorney, Agent, or Firm*—Thomas A. O'Rourke; Bodner & O'Rourke, LLP

(57) ABSTRACT

The two-point mortise latch of the present invention includes, a central actuator having teeth that are meshed with the teeth of a gear wheel, wherein the gear wheel and the central actuator are pivotally connected to at least one hook, via the hook arm. Wherein the top and bottom surfaces of the hooks have guide protrusions that are set in a guide their respective guide areas. The hooks are designed to contact the bottom interior surface of the keeper housing when latched. The central actuator and gear are meshed together via teeth. In addition, the central actuator and gear wheel are biased with springs so as to facilitate opening and closing of the door latch. The components of the present invention are retained inside of the housing, which is set inside the lock stile of a door.

16 Claims, 12 Drawing Sheets

MORTISE LOCK FOR A SLIDING DOOR

FILED OF THE INVENTION

The present invention relates to sliding door locks in particular sliding door locks, which implement a two point mortise.

BACKGROUND OF THE INVENTION

Mortise locks and latches have been implemented for over a century. Generally, mortise locks and latches require a rectangular hole in the door edge for installation, and for all intensive purposes are identical, the only difference is that a mortise lock actually locks whereas a mortise latch only latches. The present invention is compatible with either type of mortise door system. For the purposes of brevity a mortise latch will be described only, keeping in mind that the present invention may be used with a mortise lock just as easy.

A mortise latch (mortice lock in British English) is one that requires a pocket—the mortise—to be cut into the door or piece of furniture into which the lock is to be fitted. In most parts of the world, mortise latches are generally found on older buildings constructed before the advent of bored cylindrical locks, but they have recently become more common in commercial and up market residential construction in the United States. The parts included in the typical mortise lock installation are the lock body (the part installed inside the mortise cut-out in the door); the lock trim (which may be selected from any number of designs of doorknobs, levers, handle sets and pulls); a strike plate, or a box keep, which lines the hole in the frame into which the bolt fits; and the keyed mortise cylinder which operates the locking/unlocking function of the lock body. However, in the United Kingdom, and certain other countries, most mortise locks on dwellings do not use cylinders, but have lever tumbler mechanisms. The installation of a mortise latch cannot generally be undertaken by the average homeowner since it is labor intensive and requires a working knowledge of basic woodworking tools and methods. Many installation specialists use a mortising jig which makes precise cutting of the pocket a simple operation, but the subsequent installation of the external trim can still prove problematic if the installer is inexperienced. Although the installation of a mortise latch actually weakens the structure of the typical timber door, a mortise latch does offer more versatility than a bored cylindrical latch, both in external trim, and functionality. Whereas the latter mechanism lacks the architecture required for ornate and solid-cast knobs and levers, the mortise latch can accommodate a heavier return spring and a more solid internal mechanism, making their use possible. Furthermore, a mortise lock will typically accept a wide range of other manufacturers' cylinders and accessories, allowing architectural conformity with lock hardware already on site. Some of the most common manufacturers of mortise locks in the United States are Baldwin, Emtek, Falcon, Schlage, and Sargent. Also, many European manufacturers whose products had been restricted to "designer" installations have recently gained wider acceptance and use.

Typical mortise latches or locks are offered in a complete range of functions designed for commercial and institutional applications. They are engineered for strength and performance, and precisely manufactured to exacting standards. Components are interchangeable for functionality and versatility. Some mortise locks are designed with high quality components to provide high security, performance and durability. They are well suited for commercial facilities with exposed perimeter doors, such as warehouses, factories and malls. Other facilities that may implement mortise door locks are hospitals, schools, universities, factories, and office buildings. Still other mortise door locks are designed for use on those openings that are subjected to expected extreme abuse, vandalism, and malicious impact, such as in asylums, detention centers, commercial facilities with exposed perimeter doors as in warehouses and malls.

OBJECTS OF INVENTION

It is an object of the present invention to provide a mortise door lock that is easy, and cost effective to manufacture.

It is an object of the present invention to provide a mortise lock that is easy to install.

It is an object of the present invention to provide an improved mortise lock which offers added security and performance over other two-point mortise locking systems.

It is another object of the invention to provide an improved mortise lock having a single actuator which may deploy two locking hooks simultaneously.

It is still another object of the present invention to provide an improved mortise lock that will not require a large bored cavity fro installation.

These and other objects of the present invention will become apparent to those skilled in the art from a review from the description provided below.

SUMMARY OF INVENTION

The instant invention is structured around the concept of controlling a two-point mortise latch or lock, which may be used to engage a locking hook, via a central actuator. The central actuator is designed to simultaneously rotate two locking hooks via a linkage system. Prior art, as in U.S. Pat. No. 6,688,656 issued to Truth Hardware Corp., implement multi-point door locks with individual housing for each of their locking hooks. This type design is unduly difficult to manufacture and even more difficult to install. The two-point door latch of the present invention utilizes a linking system that implements a small amount of internal components, which allows for a simple cost effective manufacturing process. In addition, because the design of the present invention does not require large amounts of internal components, the size of the present invention, when compared to prior art, is relatively small, and thus easier to install. Furthermore, because the size of the present invention is small, the amount of material that must be bored from the stile of the door is much less then the amount that would have to be bored when installing other types of mortise locks. This is significant because the integrity of the door will not be compromised as much as with other prior art, i.e. the larger the configuration of the mortise lock the more door material that will have to be removed. The hooks of the present invention simultaneously pivot from a retracted deactivated position to an extended activated position. The simultaneous movement of the hooks is accomplished via hook arms and gear arms, which are pivotally connected. In addition, the central actuator and the gear wheel of the present invention are biased via springs.

BRIEF DESCRIPTION OF INVENTION

FIG. 1 is an expanded view of the two point mortise latch orientated above the keeper portion of the present invention.

FIG. 2. is an exploded view of the two point mortise latch.

FIG. 2*a* is an opposite side view of FIG. 2.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
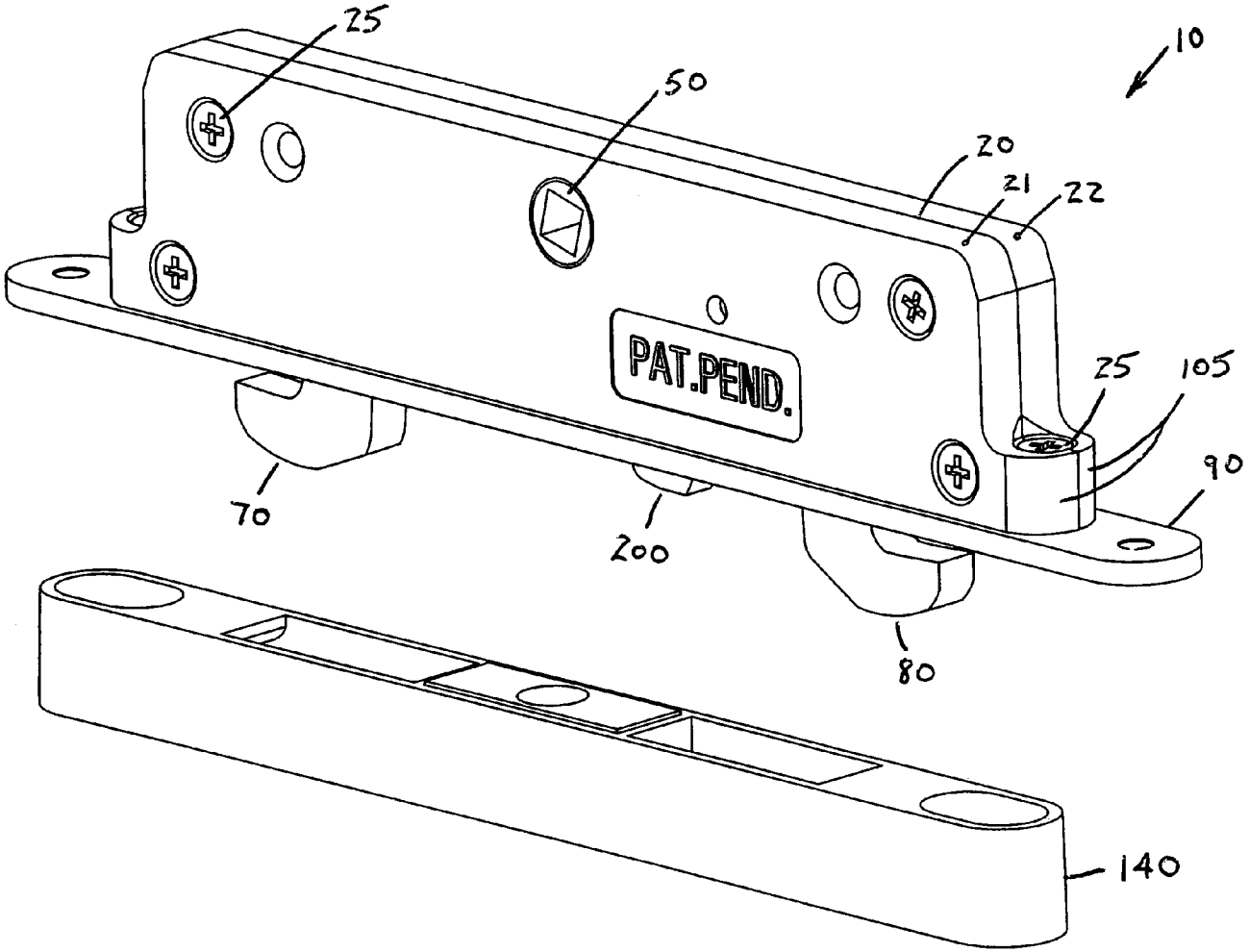
Figure 2:
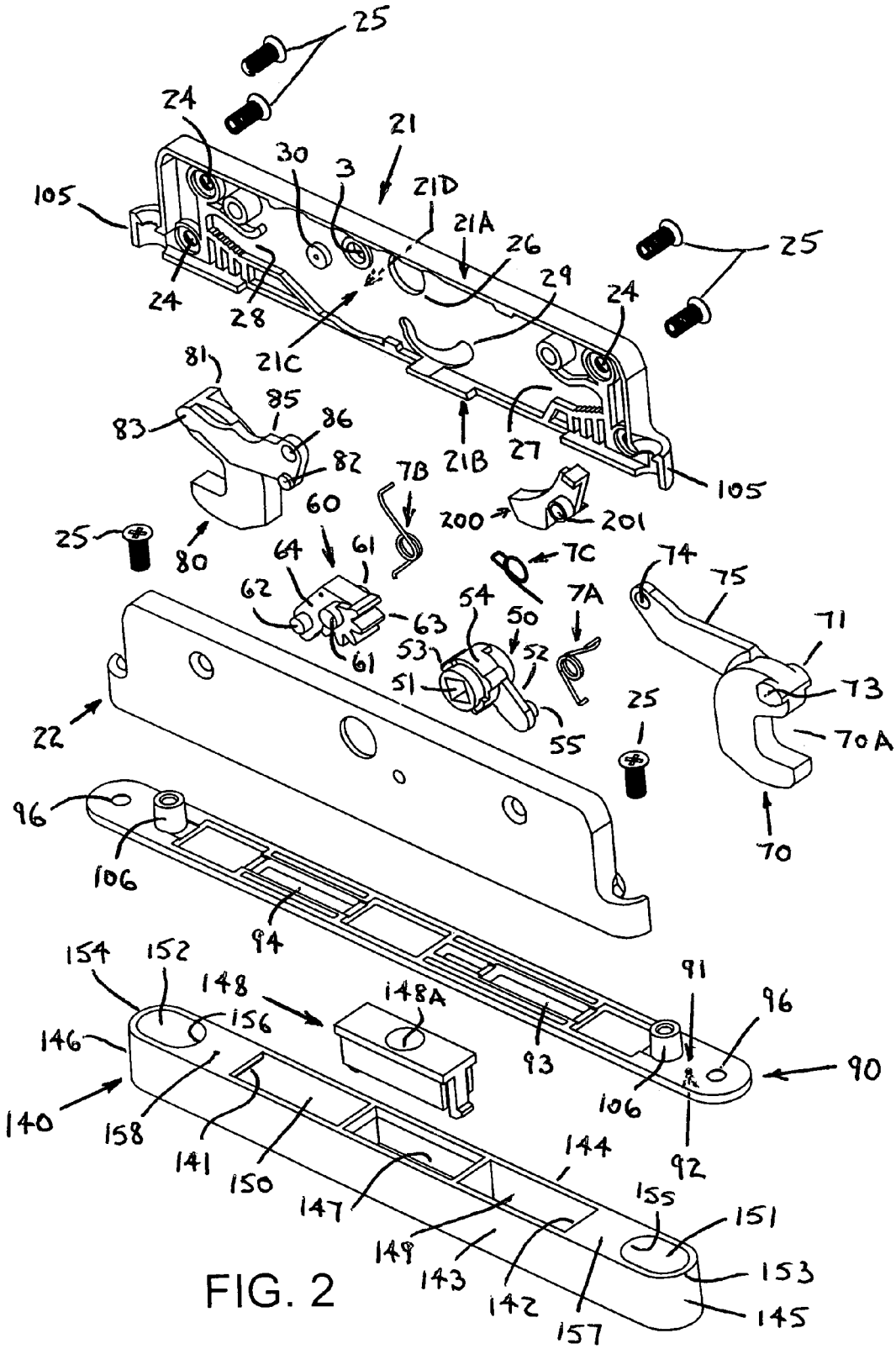
Figure 2A:
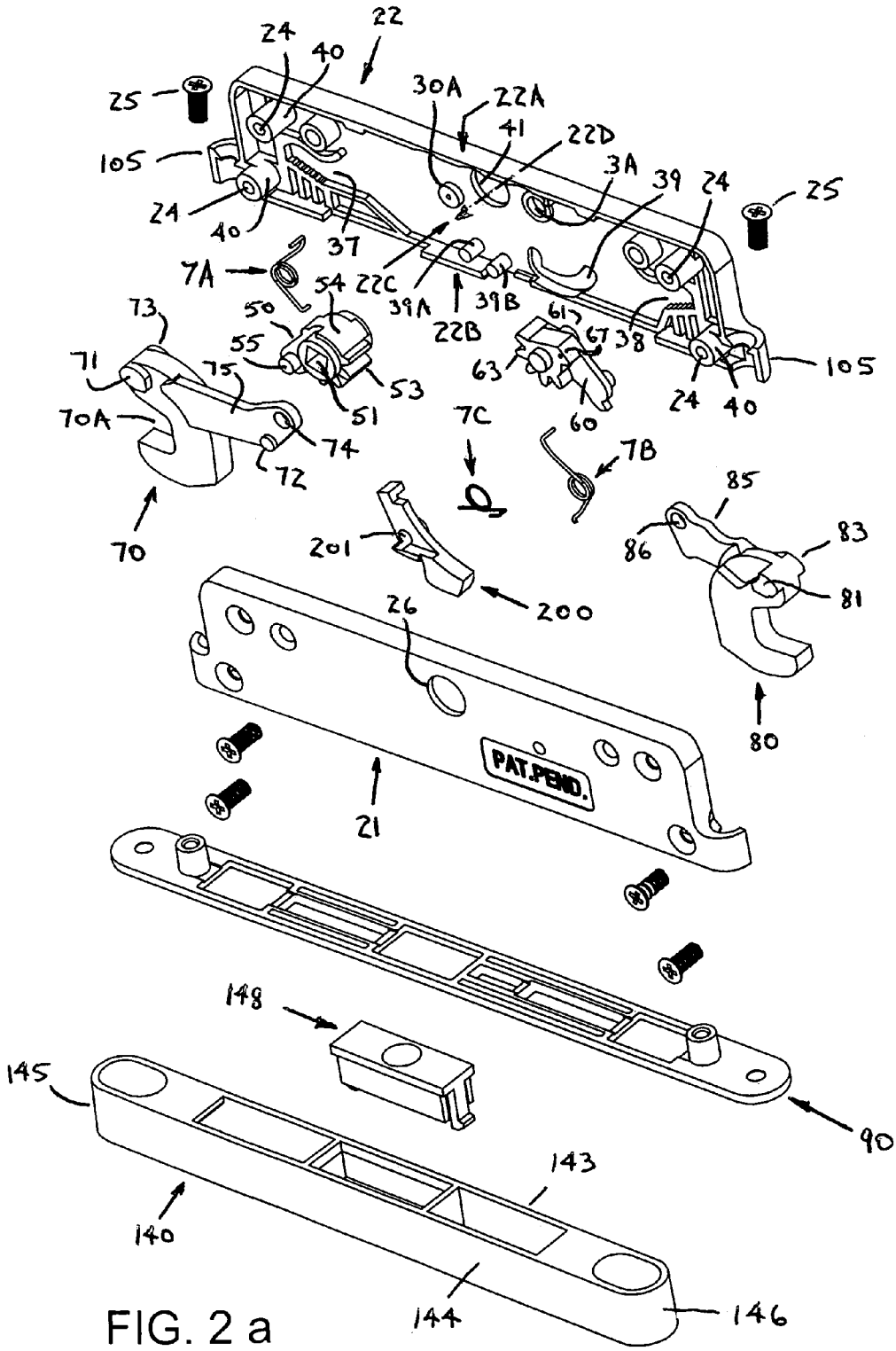

FIG. 1 illustrates an exemplary embodiment of the instant invention wherein the main components of the two-point mortise door latch 10 for sliding glass doors generally include a central actuator 50, two hooks, 70 and 80, which are in an opposed orientation in relation to each other, and a housing 20. Hooks 70 and 80 each may have linkage lever arms 75 and 85 respectively, attached to a hub portion of both hooks. Another component of the two-point mortise latch 10 is keeper housing 140, which may contain at least one keeper 141. In the preferred embodiment one implemented an upper and lower keeper, 141 and 142 respectively, as seen in FIGS. 1, 2, 2*a*. All components of the present invention may be made from any suitable material known in the art including but not limited to metal, metal alloy, industrial strength plastics and the like. In the preferred embodiment one implemented a variety of elemental metals and metal alloys for all parts of the present invention.

Figure 3:
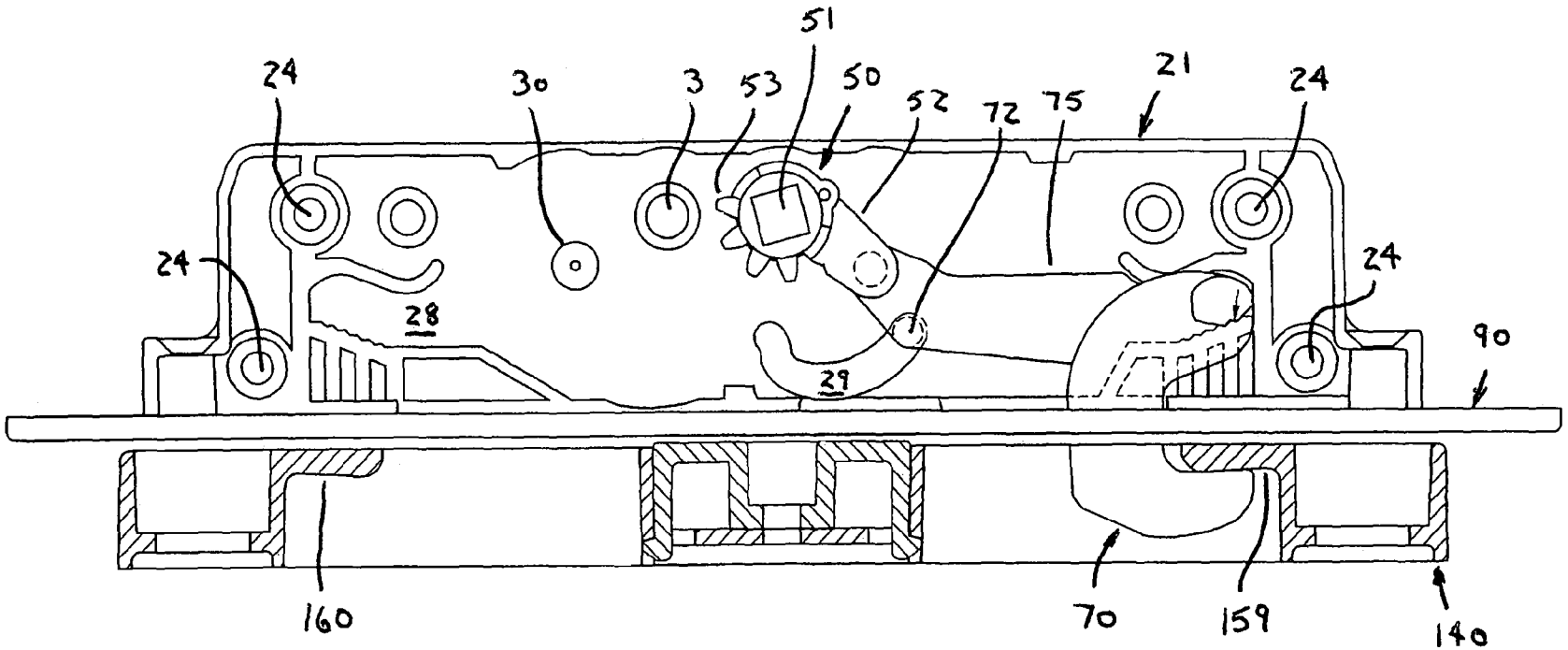
FIG. 3 is a side cutout view of the two point mortise latch assembly.
Figure 4:
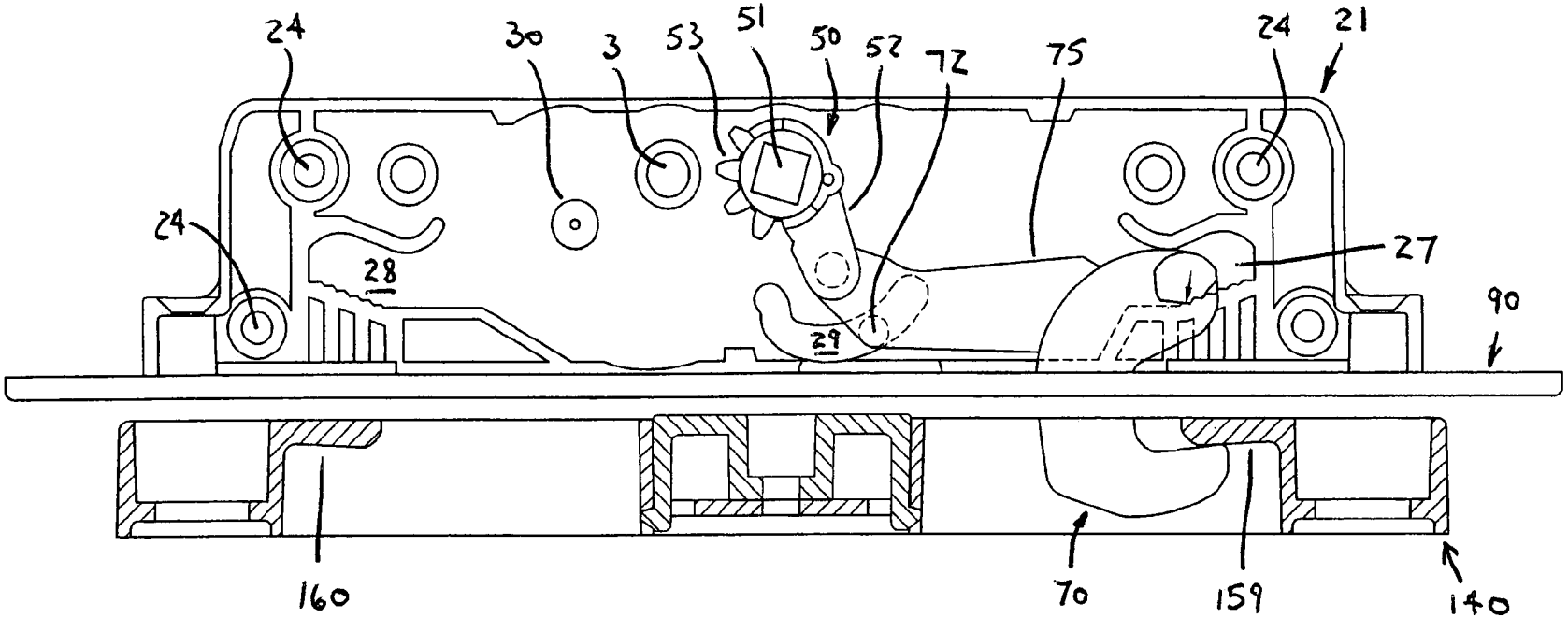
FIG. 4 is another side cutout view of the two point mortise latch assembly.
Figure 6:
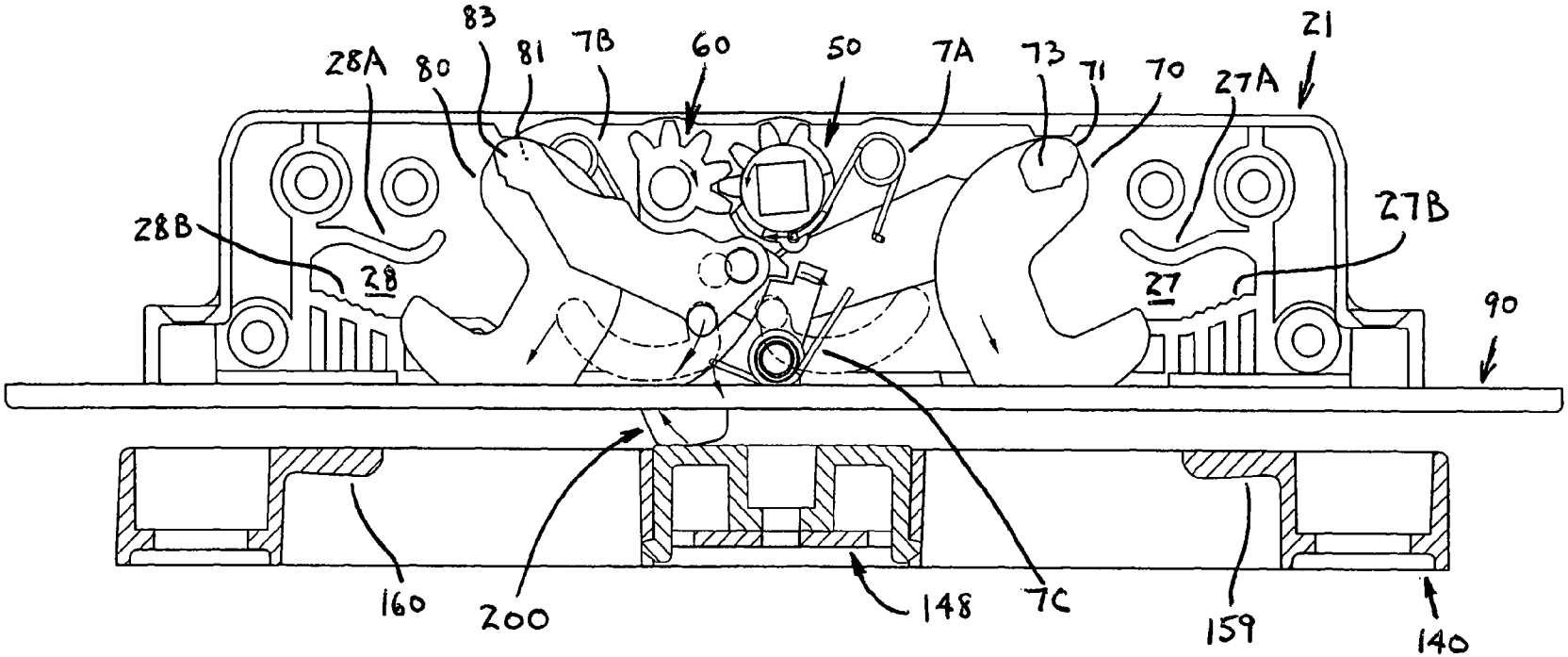
FIG. 6 is side view of the two point mortise latch assembly unlatched.

Turning again to FIG. 1, two-point mortise lock includes a housing assembly 20 that houses the necessary components of the present invention. Housing 20 may have a first sidewall 21 and a second sidewall 22 that may be connected by any suitable known connection method known in the art including but not limited to screws, pins, and the like. In the preferred embodiment screws 25 were implemented, as seen in FIGS. 2 and 2*a*. First and second sidewall members 21 and 22, respectively, may have top surfaces, 21*a* and 22*a*, respectively, and bottom surfaces 21*b* and 22*b*, respectively, as seen in FIGS. 2 and 2*a* In addition, sidewall members 21 and 22 may have inner surfaces 21*c* and 22*c*, respectively, and outer surfaces, 21*d* and 22*d*, respectively. Sidewall members 21 and 22 may have different apertures, protrusions, and grooves located on their respective inner and outer surfaces. For example, inner surfaces 21*c* may have four apertures 24, for receiving fasteners 25. In one embodiment apertures 24 may be flushed with inner surface 21*c*, or as in the preferred embodiment aperture 24 may extend in a generally perpendicular direction from inner surface 21*c* to form a recessed protrusion, as seen in FIGS. 3 and 4. Apertures 24 may extend from outer surface 21*d* of sidewall member 21 to inner surface 21*d* of sidewall 21. One skilled in the art will appreciate that aperture 24 may be generally sized and shaped to be able to receive fastener 25. Sidewall member 21 may also have a generally circular aperture 26 located near its top center. Aperture 26 also extends from outer surface 21*d* to inner surface 21*c*. It will be appreciated by one skilled in the art that aperture 26 will be generally sized to receive central actuator 50. In addition to having apertures 24 and 26, inner surface 21*c* of sidewall member 21 may have grooves located thereto, as mentioned above. For example, inner surface 21*c* may have a generally circular bored groove 3 located near the vicinity of aperture 26, which may be used to receive top protrusion 61 of gear member 60, as seen in FIGS. 3 and 4 Inner surface 21*c* of sidewall member 21 may also have guide regions 27 and 28, formed by ridges 27A and 27B, and 28A and 28B, respectively (FIG. 6). Guide regions 27 and 28 retain protrusions 71 and 81 of hooks 70 and 80 respectively, as seen in FIGS. 3 and 4. Inner sidewall 21*c* of side member 21 may also have a generally semi-parabolic shaped bored cavity 29 to receive and retain protrusion 72 of hook member 70. Inner surface 21*c* of sidewall 21 may also have a generally circular protrusion 30 extending perpendicularly from inner surface 21*c*. Protrusion 30 may have an aperture located near its center for receiving a portion of a resilient member 7*b*.

In normal operation sidewall member 21 will serve as one half of housing 20. In addition, sidewall 21 will allow hooks 70 and 80 to traverse from a retracted deactivated position to an extended activated position, via guide regions 27, 28, and semi-parabolic bored cavity 29.

As mentioned above housing 20 may be formed by sidewall 21 and sidewall 22. Turning one's attention now to FIGS. 1, 2, and 2*a*, one will discuss the elements of sidewall 22.

Figure 5:
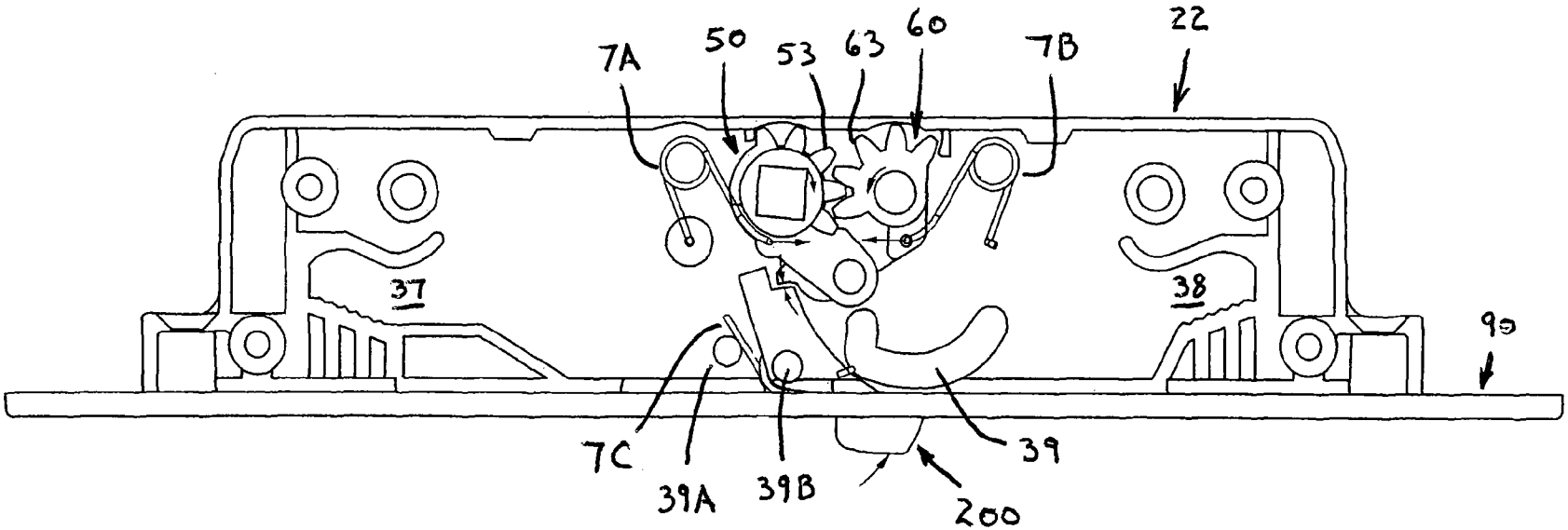
FIG. 5 is a side view of the two point mortise latch without the hooks.
Figure 9:
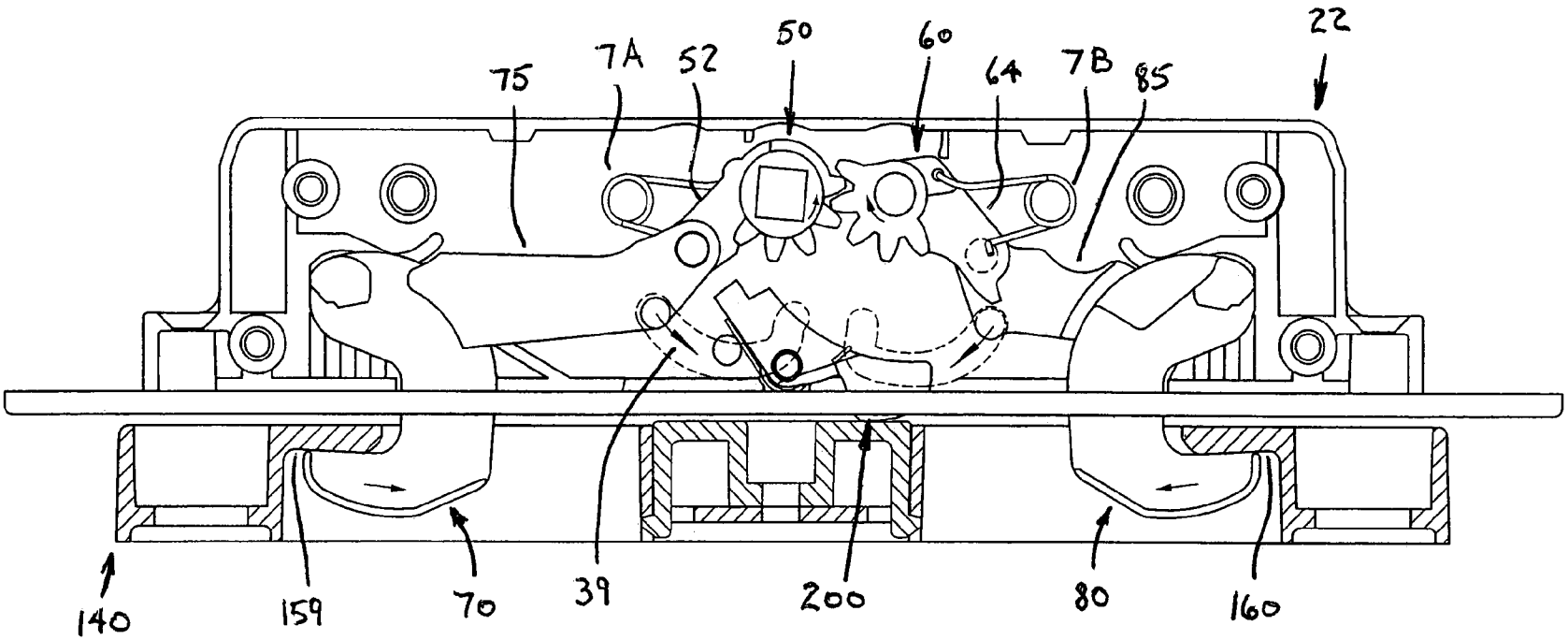
FIG. 9 is an opposite side view of FIG. 8, of the two point mortise latch assembly latched.
Figure 10:
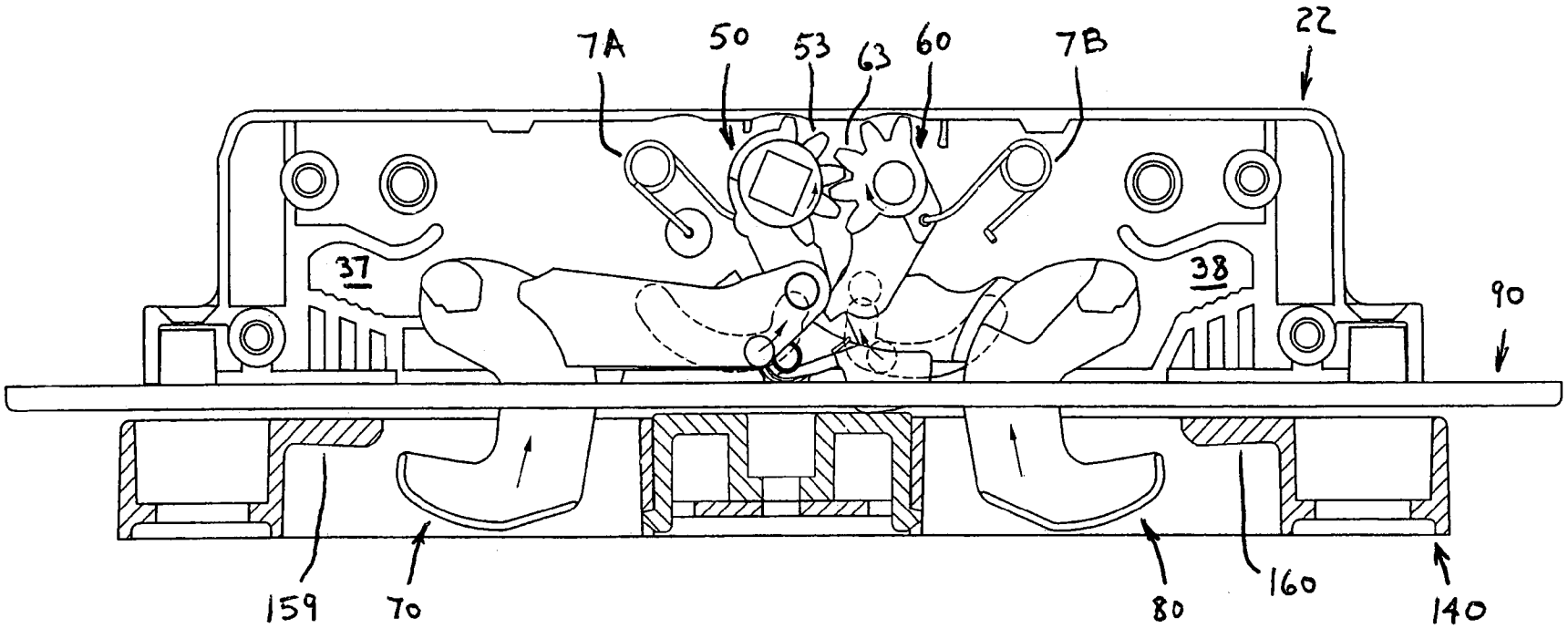
FIG. 10 is an opposite side view of FIG. 7, of the two point mortise latch assembly with the hooks exposed.
Figure 11:
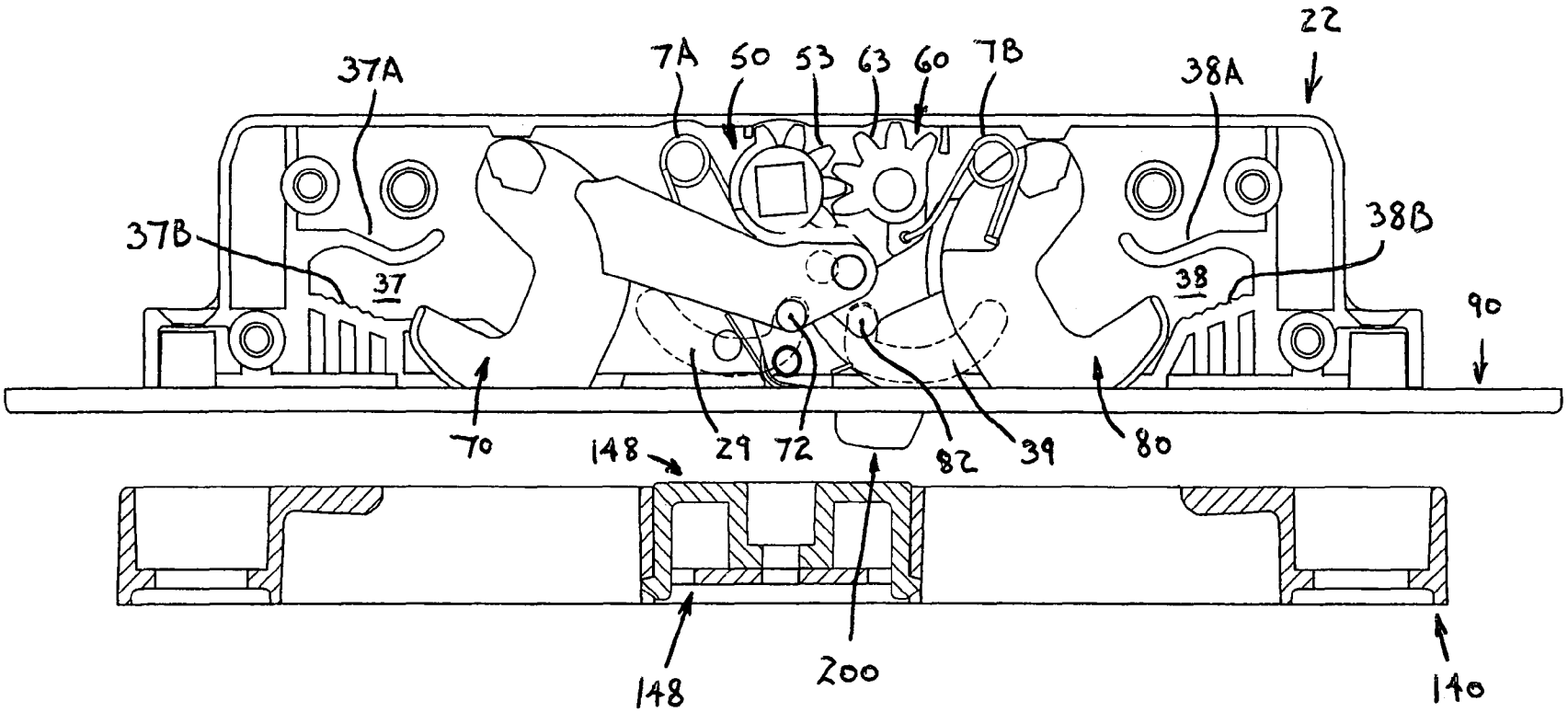
FIG. 11 is an opposite side view of FIG. 6, of the two point mortise latch assembly unlatched.

As in sidewall member 21, sidewall member 22 may have different grooves, cavities, protrusions and apertures. Inner surface 22*c* of sidewall member 22 may have four protrusions 40. Protrusions 40 may be of any suitable shape known in the art including but not limited to a circle, square, or the like. In the preferred embodiment one implemented four generally cylindrical protrusions. Protrusions 40 may extend in a generally perpendicular direction from inner surface 22*c* of sidewall member 22. One skilled in the art will appreciate that protrusion 40 may be generally sized and shaped to be able to receive fastener 25. In addition protrusion 40 may be threaded or smooth. In the preferred embodiment one implemented threaded protrusions so as to be able to receive threaded fasteners 25. Sidewall member 22 may also have a generally circular aperture 41 located near its top center area. Aperture 41 also extends from outer surface 22*d* to inner surface 22*c*. It will be appreciated by one skilled in the art that aperture 41 will be generally sized to receive central actuator 50. In addition to having protrusions 40 inner surface 22*c* of sidewall member 22 may have grooves located thereto, as mentioned above. For example, inner surface 22*c* may have a generally circular bored groove 3*a* located near the vicinity of aperture 41, which may be used to receive upper protrusion 61 of gear member 60. Inner surface 22*c* of sidewall member 22 may also have guide regions 37 and 38, formed by ridges 37A and 37B, and 38A and 38B, respectively (FIG. 11). Guide regions 37 and 38 retain protrusions 73 and 83 of hooks 70 and 80 respectively, as seen in FIG. 5. Inner sidewall 22*c* of side member 22 may also have a generally semi-parabolic shaped bored cavity 39 to receive and retain protrusion 82 of hook member 80. Inner surface 22*c* of sidewall 22 may also have a generally circular protrusion 30*a* extending perpendicularly from inner surface 22*c*. Protrusion 30*a* may have an aperture located near its center for receiving a portion of a resilient member 7*a*. Inner surface 22*c* may also have two cylindrical posts adjacent to each other 39*a* and 39*b*, which enable the motion of release lever 200, whereby orifice 201 in lever 200 is pivotally mounted to post 39*b* (FIG. 2A) and post 39*a* supports one end of resilient member 7*c* (FIG. 9).

Sidewalls 21 and 22 may each have two half sleeves 105 located adjacent to side surfaces 21*b* and 22*b*, as seen in FIG. 1. In normal operation when sidewalls 21 and 22 are connected, half sleeves 105 will join to form two full sleeves, as seen in FIGS. 1, 2, and 2*a* so as to be able to receive at least one screw and house at least one protrusion 106 of faceplate 90, as seen in FIG. 2.

Housing 20, as mentioned above, may have a faceplate 90, which may be used to enclose housing 20. Faceplate 90 may be of generally rectangular shape with generally rounded front and rear ends, as seen in FIG. 1. Faceplate 90 may have a top inner surface and a lower outer surface, 91 and 92 respectively. Faceplate 90 may have at least one access aperture located near the center of faceplate 90. In the preferred embodiment faceplate 90 had top and bottom access apertures, 93 and 94 respectively, as seen in FIG. 2. Access apertures 93 and 94, allow hooks 70 and 80, to pivot from a retracted open position to an extended closed position, as seen in FIGS. 2, 4, 5, and 6. In addition, one may also have at least one aperture 96 located near the center, of rounded front and rear ends. In the preferred embodiment one implemented two generally circular apertures 96. Apertures 96 may be used for mounting two-point mortise lock 10 to the stile of a sliding door member. As mentioned previously, one may also have at least one protrusion located on faceplate 90. In the preferred embodiment one implemented two generally cylindrical threaded protrusions 106. It will be appreciated by those skilled in the art that one may implement protrusions of any geometrical shape and size, and such protrusions may or may not be threaded; depending on the fastening method implemented. Protrusions 106 may extend in a generally perpendicular direction in reference to plane of top inner surface 91. As mentioned previously, one may attach faceplate 90 to housing 20 by any suitable attachment methods known in the art including but not limited to adhesives, screws, or the like. In the preferred embodiment one implemented two screws similar to those used to attach sidewalls 21 and sidewalls 22. After sidewalls 21 and 22 are connected, half sleeves of sidewalls 21 and 22 will form full sleeve 105, thus forming a tight fit over cylindrical protrusions 106, so as to display a smooth aesthetically pleasing appearance to the user. Generally, before installation, a recess of suitable dimensions may be bored into stile of sliding door. After assembly, housing 20 of two-point mortise lock 10 may be placed inside of recess and mounted to stile of sliding door, via screws 25.

Figure 8:
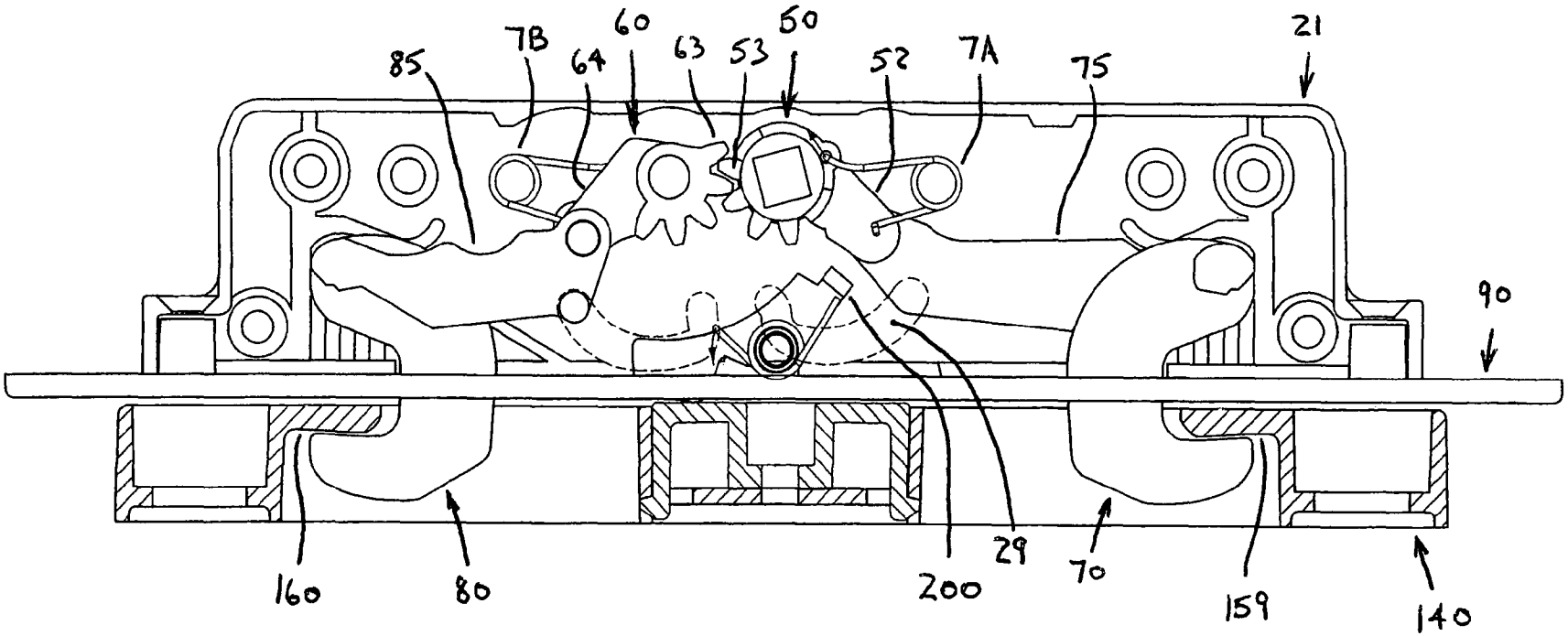
FIG. 8 is a side view of the two point mortise lock assembly latched.

Turning one's attention again to FIGS. 1 and 2 one will describe keeper housing 140 in more detail. Keeper housing 140 may be of generally the same shape as faceplate 90. Keeper housing 140 may have sidewalls 143 and 144, along with generally rounded front and rear ends, 145 and 146 respectively. It will be appreciated by one skilled in the art that the dimensions of keeper housing 140 will be such that hooks 70 and 80 will be able to pivot from an open retracted position to a closed extended position. Located near the center of keeper housing 140 may be a cavity 147. Cavity 147 may be of such dimensions so as to be able to receive reinforcing member 148, as seen in FIG. 1. Reinforcing member 148 may be of generally rectangular shape with an aperture 148*a* located near its center, aperture 148*a* may be implemented to facilitate mounting keeper housing 140 to the jamb of the sliding door. Keeper housing 140 may also have at least one aperture located on its front surface. In the preferred embodiment one implemented upper and lower apertures, 149 and 150 respectively. Apertures 149 and 150 may be used to receive hooks 70 and 80, respectively. As mentioned above faceplate 140 may have generally rounded front and rear ends, 145 and 146 respectively. Font and rear ends also may have front and rear apertures, 151 and 152 respectively, as seen in FIGS. 1, 2, and 8. Apertures 151 and 152 may be defined with generally circumferential outer top edges 153 and 154 respectively, and generally circumferential inner surfaces 155 and 156 respectively. Apertures 155 and 156 may be used to receive fastening means, such as a screw or the like, for mounting keeper housing 140 to jamb of door. Extending from outer top edges in a direction toward the center may be surfaces 157 and 158. Surfaces 157 and 158 may extend a distance that will allow hooks 70 and 80 to retract and extend into apertures 149 and 150 of keeper housing 140. In addition, surfaces 157 and 158 may act as keepers for hooks 70 and 80 respectively, as in the preferred embodiment. Surfaces 157 and 158 may be smooth, or ribbed, depending on the desired finished look. In normal operation the outer surface of hooks 70 and 80 may contact the bottom surfaces 159 and 160 of surfaces 157 and 158 respectively, thus preventing opening of the door.

If a different finished look is desired by the user one may implement a variety of other different keeper techniques. It will be appreciated by one skilled in the art that one may use any type of suitable keeper known in the art including but not limited to a bar, bolt, pin, rod, or the like. For example, in a different embodiment one may implement two generally cylindrical keeper bars that may extend from a first sidewall to a second sidewall of keeper housing 140.

In normal operation, no matter which embodiment of the present invention is implemented, keeper housing 140 will be installed inside of a bored cavity located in doorjamb. The location of keeper housing 140, inside of doorjamb, will depend on the location of the two-point mortise lock, i.e. the two members will be aligned so that apertures 149 and 150 of keeper housing 140 may receive of hooks 70 and 80*a* of two-point mortise lock.

A detailed description of the internal components will now be discussed. Referring to FIG. 1 one may view the internal components of the present invention. Located near the center of housing 20 may be aperture 126. Aperture 126 is formed by connecting sidewall 21 and sidewall 22, i.e. placing apertures 26 and 41 along the same central axis of rotation. Aperture 126 may be implemented to retain central actuator 50.

Figure 7:
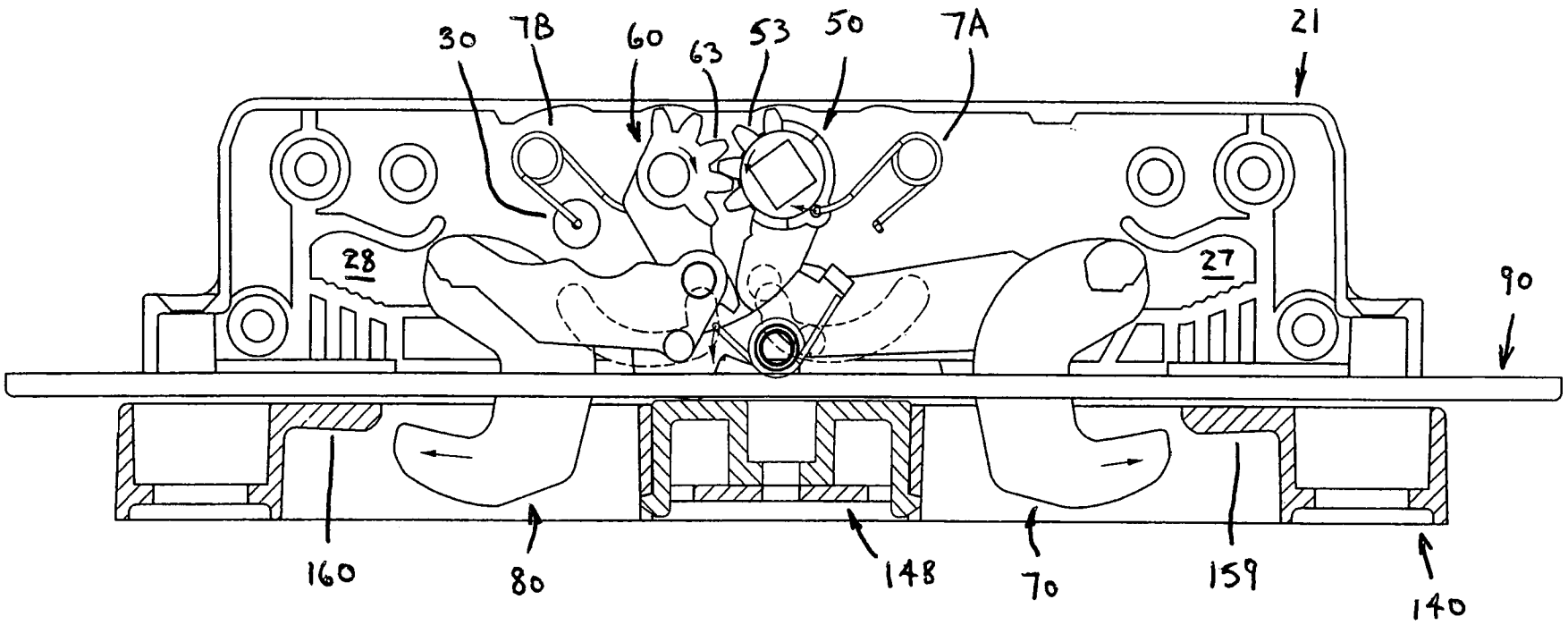
FIG. 7 is a side view of the two point mortise latch assembly with the hooks exposed.

Central actuator 50 may be generally cylindrical in shape with an aperture 51 located near its center. Aperture 51 may be any suitable known shape in the art; in the preferred embodiment one implemented a generally square aperture. Aperture 51 may be used to receive the tail end of a turning mechanism, such as a key. In another embodiment of the present invention, central actuator 50 may have a lever attached, thus no key would be needed to open or close the door, and one would simply turn the lever to retract or extend hooks 70 and 80. Located on the outer, generally circumferential surface, of central actuator 50 may be teeth 53. Teeth 53 mesh with teeth 63 of gear 60, as seen in FIGS. 5, 6, and 7. In addition central actuator 50 may have an arm 52 that may extend tangentially from generally outer circumferential surface 54 of central actuator 50. Located on and extending from the top surface of arm 52 of central actuator 50 may be a protrusion 55. Protrusion 55 may be of any suitable structures known in the art including but not limited to a peg, pin, or the like. In the preferred embodiment one implemented a generally cylindrical shaped post 55. Post 55 may be a separately attached member or post 55 may be integrally formed with actuator 50. In the preferred embodiment post 55 was integrally formed so as to increase the integrity of the door latch. Central actuator 50 may also have an aperture 56 located on bottom surface of arm 52. It will be appreciated by those skilled in the art that aperture 56 may be of such dimensions so as to retain a portion of a resilient member 7*a*. In normal operation post 55 is retained inside of aperture 74, as seen in FIG. 2, located on arm 75 of hook 70, thus forming one part of the linkage system of the present invention. As mentioned above central actuator 50 may be biased with resilient member 7*a*. Any type of suitable resilient member known in the art including but not limited to a spring, band, or the like may be implemented. In the preferred embodiment one implemented a coil spring.

As mentioned above, central actuator 50 co-acts with hook 70, via the linkage system, and co-acts with gear 60, via meshing of teeth 53 and teeth 63. Gear 60 is of generally the same shape as central actuator 50, however, as mentioned previously, gear 60 has top and bottom protrusions 61 and 62, respectively. In addition gear 60 may have an arm 64 that may extend tangentially from generally outer circumferential surface 65 of gear 60. Located on and extending from the top surface of arm 64 of gear 60 may be a protrusion 62. Protrusion 62 may be of any suitable structures known in the art including but not limited to a peg, pin, or the like. In the preferred embodiment one implemented a generally cylindrical shaped post 62. Post 62 may be a separately attached member or post 62 may be integrally formed with gear 60. In the preferred embodiment post 62 was integrally formed so as to increase the integrity of the door latch. Gear 60 may also have an aperture 67 located on bottom surface of arm 64. It will be appreciated by those skilled in the art that aperture 67 may be of such dimensions so as to retain a portion of a resilient member 7*b*. In normal operation post 62 is retained inside of aperture 86 located on arm 85 of hook 80, thus forming the other part of the linkage system of the present invention. As mentioned above gear 60 may be biased with resilient member 7*b*. Any type of suitable resilient member known in the art including but not limited to a spring, band, or the like may be implemented. In the preferred embodiment one implemented a coil spring.

In normal operation when the user desires to open or lock the door the user may insert a turning mechanism and rotate central actuator 50. The rotation of central actuator 50 will cause hook 70 to traverse inside guide member via the linkage system.

A more detailed description of hooks 70 and 80 will now be discussed. One will first discuss hook 70, since it is connected to central actuator 50. Hook 70 may have a generally "C" shaped locking portion 70*a* and an arm portion 75, as mentioned previously. In addition hook 70 may have protrusions, or pins 71 and 73 that are retained in guide areas 27 and 37 respectively, and protrusion, or pin 72, which is retained in semi-parabolic grooved region 29. In addition hook 80 may have protrusion or pin 82, which may serve the same function as pin 72 of hook 70, except pin 82 of hook 80 will be retained inside semi-parabolic region 39 of sidewall 22. In one embodiment arm portion 75 of hook 70 may have a length that is slightly longer then that of arm portion 85 of hook 80. This length differential allows for maximum pivot capability inside of housing 20. In another embodiment one may have arm portions 75 and 85 equal in length. As mentioned previously hooks 70 and 80 may have protrusions 71, 73, and 72, and 82, 83, and 81, respectively. In one embodiment one may have arms 75 and 85 integrally formed with protrusions 71 and 83, respectively, or as in the preferred embodiment one may have only arm 85 of hook 80 integrally formed with protrusion 83. If one implements this type of configuration, it will also allow for maximum pivot capability inside of housing 20.

In the present invention keeper portion 140 may be mounted to the side of a door jamb with or without a gasket. If one desired to mount keeper housing 140 with a gasket, as in the preferred embodiment, any suitable gasket known in the art including, but not limited to paper, rubber, silicone, metal, felt, fiberglass, plastic polymers or the like. In the preferred embodiment one implemented a plastic polymer.

In normal operation when the user desires to open or close the sliding door the user will turn central actuator 50, via a key member or a lever member. The rotational movement of central actuator 50 will cause teeth 53 of central actuator 50 and teeth 63 of gear 60 to rotate, which in turn will cause a translational movement of arms 75 and 85 of hooks 70 and 80, respectively, to pivot, thus causing protrusions 71, 73, and 72 of hook 70, to traverse inside of guide areas 27, 37, and semi-parabolic shaped cavity 29, respectively. In addition protrusions 81, 83, and 82 of hook 80, will traverse inside guide areas 28, 38, and semi-parabolic shaped bored cavity 39, respectively. This co-action between central actuator 50, gear wheel 60, and arms 75 and 85 of hooks 70 and 80 respectively will cause both hooks to simultaneously pivot outwardly to a latched position against contacting surfaces 159 and 160, and conversely to simultaneously pivot inwardly to an unlatched position.

As various changes could be made in the above constructions without departing from the scope of the invention, it is intended that all matter contained in the above description shall be interpreted as illustrative and not in a limiting sense. In the view above it will be seen that several objects of the invention are achieved and other advantageous results attained.

We claim:

1. A door latch for a sliding door; said door having an opening in a lock face of a stile of said door, said latch comprising a housing, said housing having a first sidewall portion and a second sidewall portion; said first and second sidewall portions comprising an inside surface and an outside surface; said housing having a first hook and a second hook pivotally mounted in said housing and also therein being capable of translation by having a cylindrical member extending outwardly on each of said hooks, each said cylindrical member received within a curved groove in said housing, each of said hooks having a first end for latching to a keeper on a jamb, and a second end having a pair of protrusions that are received in a guide area after at least a portion of said translation, each of said guide areas comprising a first ridge and a second ridge extending from said inside surface of said first and second sidewall portions, each of said first and second ridges comprising at least an inner surface to form said guide area for receiving said second end of said hook, each of said hooks having an arm extending therefrom, said hooks being adapted to move between a retracted position and an extended latched position; and an actuator, said actuator having an orifice for receiving a tail member, said arm having a circumferential sidewall pivotally mounted within a first orifice in said first sidewall portion and a second orifice in said second sidewall portion, said actuator having an arm extending from said circumferential sidewall, said actuator arm being pivotally connected to said arm extending from said first hook, said actuator arm having a top surface and a bottom surface with a pin extending therefrom, said pin being received in an orifice in said arm of said first hook to provide said pivotal connection, said bottom surface of said actuator arm having an aperture for receiving one end of a first spring, a second end of said spring being received in an aperture in said housing to bias said actuator relative to said housing, said actuator having a plurality of teeth extending from at least a portion of said circumferential sidewall of said actuator, said teeth meshing with a plurality of teeth of a gear wheel, said gear wheel comprising a pair of pins being received in a raised ring in each of said first and second sidewall portions for pivotal mounting of said gear wheel therein, said actuator teeth meshing with said gear wheel teeth causing said gear wheel to pivot as said actuator, said gear wheel having an arm extending from a sidewall of said gear wheel, said arm of said gear wheel having a top surface and a bottom surface and wherein one of said top and bottom surfaces has an aperture for receiving an end of a second spring and wherein a second end of said spring is received in an aperture in said housing to bias said gear wheel relative to said housing, said arm of said gear wheel being pivotally connected to said arm of said second hook, said gear wheel bottom surface having a pin extending therefrom and being received in said arm of said second hook to provide said pivotal connection, said actuator moving said hooks from a latched position to an unlatched position and from an unlatched position to a latched position as said tail member is turned.

2. A door latch for a sliding door; said door having an opening in a lock face of a stile of said door, said latch comprising a housing, said housing having a first sidewall portion and a second sidewall portion; said first and second sidewall portions comprising an inside surface and an outside surface; said housing having a first hook and a second hook pivotally mounted within said housing and also therein being capable of translation by having a cylindrical member extending outwardly on each of said hooks, each said cylindrical member within a curved groove in said housing, each of said hooks having a first end for latching to a keeper on a jamb, and a second end having a pair of protrusions that are received in a guide area after at least a portion of said translation, each of said guide areas comprising a first ridge and a second ridge extending from said inside surface of said first and second sidewall portions, each of said first and second ridges comprising at least an inner surface to form a gap for receiving said second end of said hook, said hook having an arm extending therefrom, said hooks being adapted to move between a retracted position and an extended latched position; and an actuator, said actuator having an orifice for receiving a tail member, said actuator having an arm extending from a sidewall thereof, said arm being pivotally connected to said arm extending from said first hook, said actuator having a plurality of teeth extending from said sidewall of said actuator, said teeth meshing with a gear wheel, said gear wheel having an arm extending from a sidewall of said gear wheel, said arm of said gear wheel having a top surface and a bottom surface and wherein one of said top and bottom surfaces has an aperture for receiving an end of a spring, said arm of said gear wheel being pivotally connected to said arm of said second hook, said actuator moving said hooks from a latched position to an unlatched position and from an unlatched position to a latched position as said tail member is turned, and wherein said first hook has a first end that extends from said housing when said first hook is in an extended position and a second end having a pin extending from a top and bottom surface of said first hook, said pins being received in a groove in an inside surface of said sidewall position.

3. The latch according to claim 2 wherein said first hook has a first end that extends from said housing when said first hook is in an extended position and a second end having an orifice therein, said orifice receives pins extending from said inside surfaces of said sidewall portions.

4. The latch according to claim 2 wherein said groove is formed by an inside surface of said sidewall portion and at least a first ridge extending from said inside surface and a second ridge extending from said inside surface said groove having an open end and a closed end formed by said ridges.

5. The latch assembly according to claim 3 wherein there is at least one ridge having one or more teeth that contact a side of said pin.

6. The latch according to claim 2 wherein said second hook has a first end that extends from said housing when said second hook is in an extended position and a second end having a pin extending from a top and bottom surface of said second hook, said pins being received in a groove in an inside surface of said sidewall portion.

7. The latch according to claim 2 wherein said second hook has a first end that extends from said housing when said second hook is in an extended position and a second end having an orifice therein, said orifice receives pins extending from said inside surfaces of said sidewall portions.

8. The latch according to claim 6 wherein said groove is formed by an inside surface of said sidewall portion and at least a first ridge extending from said inside surface and a second ridge extending from said inside surface said groove having an open end and a closed end formed by said ridges.

9. The latch assembly according to claim 8 wherein at least one of said ridges has one or more teeth that contact a side of said pin.

10. The latch according to claim 2 wherein said first hook has a first end that extends from said housing when said first hook is in an extended position and a second end having a pin extending from a top and bottom surface of said first hook, said pins being received in a groove in an inside surface of said sidewall position; and said second hook has a first end that extends from said housing when said second hook is in an extended position and a second end having a pin extending from a top and bottom surface of said second hook, said pins being received in a groove in an inside surface of said sidewall position.

11. The latch according to claim 10 wherein said groove is formed by an inside surface of said sidewall portion and at least a first ridge extending from said inside surface and a second ridge extending from said inside surface said groove having an open end and a closed end formed by said ridges.

12. The latch assembly according to claim 11 wherein at least one of said ridges has one or more teeth that contact a sidewall of said pin.

13. The latch according to claim 2 wherein said keeper has a top exterior surface and a top interior surface and first and second sidewalls extending from said top surface, said top surface having a first and second orifice therethrough for receiving said hooks and wherein a surface of said hooks contacts said top interior surface of said keeper housing when said hooks are in an extended position.

14. A latch comprising:

a housing, said housing having a cavity formed by at least a first sidewall and a second sidewall;

a central actuator, said central actuator comprising a cylindrical portion with a keyed aperture therein, said cylindrical portion being pivotally mounted in said housing, said central actuator comprising two or more gear teeth protruding from at least a portion of said cylindrical portion; said central actuator further comprising an arm extending from said cylindrical portion;

a gear segment, said gear segment being pivotally mounted in said housing and comprising two or more gear teeth that mesh with said teeth of said central actuator whereby rotation of said central actuator causes counter-rotation of said gear segment; said gear segment further comprising an arm;

a first hook member, said first hook member comprising a hook portion extending from an arm; said arm having a first side and a second side, and a first end and a second end, said hook portion extending from said second end of said arm; said first end of said arm comprising a pivotal connection with said central actuator arm whereby motion of said actuator drives motion of said first hook member from an unlatched position within said housing; said first end of said arm comprising a cylindrical post, said cylindrical post being slidably received within a curved groove in said first housing sidewall, said groove having a width greater than said cylindrical post; said actuator driving said first hook member causes said pivotal connection of said hook to rotate with said actuator, and causes said cylindrical post to generally track according to said curved groove in curvilinear motion; said arm further comprising a protrusion extending from said first and second sides of said hook arm at said second end, each of said protrusions being received in a guide area in said housing after at least a portion of said curvilinear motion, said housing guide area comprising a first flange and a second flange extending into said housing cavity from said first and second sidewalls of said housing, said guide area causing final movement of said first hook member into a latched position with at least a portion of said hook being engaged outside of said housing;

a first spring, one end of said first spring being received in an orifice in said first hook member, and a second end of said spring being received in an orifice in said housing, said first spring biasing said first hook member to said latched position;

a second hook member, said second hook member comprising a hook portion extending from an arm; said arm having a first side and a second side, and a first end and a second end, said hook portion extending from said second end of said arm; said first end of said arm comprising a pivotal connection with said gear segment whereby counter-rotation of said gear segment drives motion of said second hook member from an unlatched position within said housing; said first end of said arm comprising a cylindrical post, said cylindrical post being slidably received within a curved groove in said second housing sidewall, said groove having a width greater than said cylindrical post; said gear segment driving said second hook member causes said pivotal connection of said second hook to rotate with said gear segment, and causes said cylindrical post to generally track according to said curved groove in curvilinear motion; said arm further comprising a protrusion extending from said first and second sides of said hook arm at said second end, each of said protrusions being received in a guide area in said housing after at least a portion of said curvilinear motion, said housing guide area comprising a first flange and a second flange extending into said housing cavity from said first and second sidewalls of said housing, said guide area causing final movement of said second hook member into a latched position with at least a portion of said hook being engaged outside of said housing;

a second spring, one end of said second spring being received in an orifice in said second hook member, and a second end of said spring being received in an orifice in said housing, said second spring biasing said second hook member to said latched position.

15. The latch according to claim 14 wherein said hook portions of said first and second hook members engage a keeper in said latched position; and wherein said improved latch is installed in a sliding door stile, and said keeper is installed in a door jamb.

16. The latch according to claim 15 wherein said improved latch further comprises a turn key member, a portion of said turn key member being formed to be slidably received in said keyed aperture in said central actuator, said turn key member thereby being capable of causing rotation and counter-rotation of said central actuator by motion of a user's hand.

* * * * *